US010856635B2

(12) United States Patent
Chee-Ping

(10) Patent No.: US 10,856,635 B2
(45) Date of Patent: Dec. 8, 2020

(54) HANDHELD MOTORIZED HAIR STYLING DEVICE

(71) Applicant: Nico M. Chee-Ping, Fairview, NC (US)

(72) Inventor: Nico M. Chee-Ping, Fairview, NC (US)

( * ) Notice: Subject to any disclaimer, the term of this patent is extended or adjusted under 35 U.S.C. 154(b) by 747 days.

(21) Appl. No.: 15/597,273

(22) Filed: May 17, 2017

(65) Prior Publication Data

US 2017/0332762 A1 Nov. 23, 2017

Related U.S. Application Data

(60) Provisional application No. 62/337,364, filed on May 17, 2016.

(51) Int. Cl.
*A45D 2/00* (2006.01)

(52) U.S. Cl.
CPC ..... *A45D 2/00* (2013.01); *A45D 2002/003* (2013.01); *A45D 2002/006* (2013.01)

(58) Field of Classification Search
CPC ..... A45D 2/00; A45D 2002/003; A45D 2002/006
See application file for complete search history.

(56) References Cited

U.S. PATENT DOCUMENTS 7,198,050 B2 * 4/2007 Gopou ..... A45D 7/00 132/210
8,651,118 B2 * 2/2014 De Benedictis ..... A45D 1/06 132/238
8,733,374 B2 * 5/2014 De Benedictis ..... A45D 2/02 132/238
8,869,808 B2 * 10/2014 De Benedictis ..... A45D 6/00 132/237
9,060,582 B2 * 6/2015 Longoria ..... A45D 2/12
2004/0060133 A1 * 4/2004 Eliav ..... A61C 17/349 15/22.1
2006/0010625 A1 * 1/2006 Tapper ..... A61H 7/005 15/97.1
2008/0104787 A1 * 5/2008 Keenan ..... A45D 34/04 15/210.1
2008/0230246 A1 * 9/2008 Dollar-Wright ..... A45D 24/007 173/29
2016/0045081 A1 * 2/2016 Kern ..... A47K 7/043 15/22.4
2017/0035649 A1 * 2/2017 Choi ..... A61H 23/02
2017/0325564 A1 * 11/2017 Eltoweissy ..... A45D 2/00
2018/0000217 A1 * 1/2018 Callis, Jr. ..... A45D 2/00

* cited by examiner

*Primary Examiner* — Nicholas D Lucchesi
(74) *Attorney, Agent, or Firm* — John L. Sotomayor

(57) ABSTRACT

The handheld motorized hair styling device is a battery-operated, motorized, hair styling tool that produces a styled pattern of curls, twists, and/or coils in hair. The handheld motorized hair styling device creates the styled pattern by moving a contoured styling pad against the hair in a roto-linear motion. The speed and direction of the roto-linear motion may be changed using controls on the handheld motorized hair styling device. The styling pad may be removed and replaced and the battery is rechargeable.

19 Claims, 8 Drawing Sheets

HANDHELD MOTORIZED HAIR STYLING DEVICE

CLAIM TO PRIORITY

This Non-Provisional application claims under 35 U.S.C. § 120, the benefit of the Provisional Application 62/337,364, filed May 17, 2016, Titled "Handheld Motorized Hair Styling Device" which is hereby incorporated by reference in its entirety.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

The present invention relates to the field of hair styling devices, specifically, a handheld motorized hair styling device.

Currently, a consumer who wishes to create a pattern of curls, twists, and/or coils in short hair must place a sponge curling tool against their head and move the tool in a circular pattern. It is a tiresome process which may cause sore arm muscles and consumes a lot of time.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
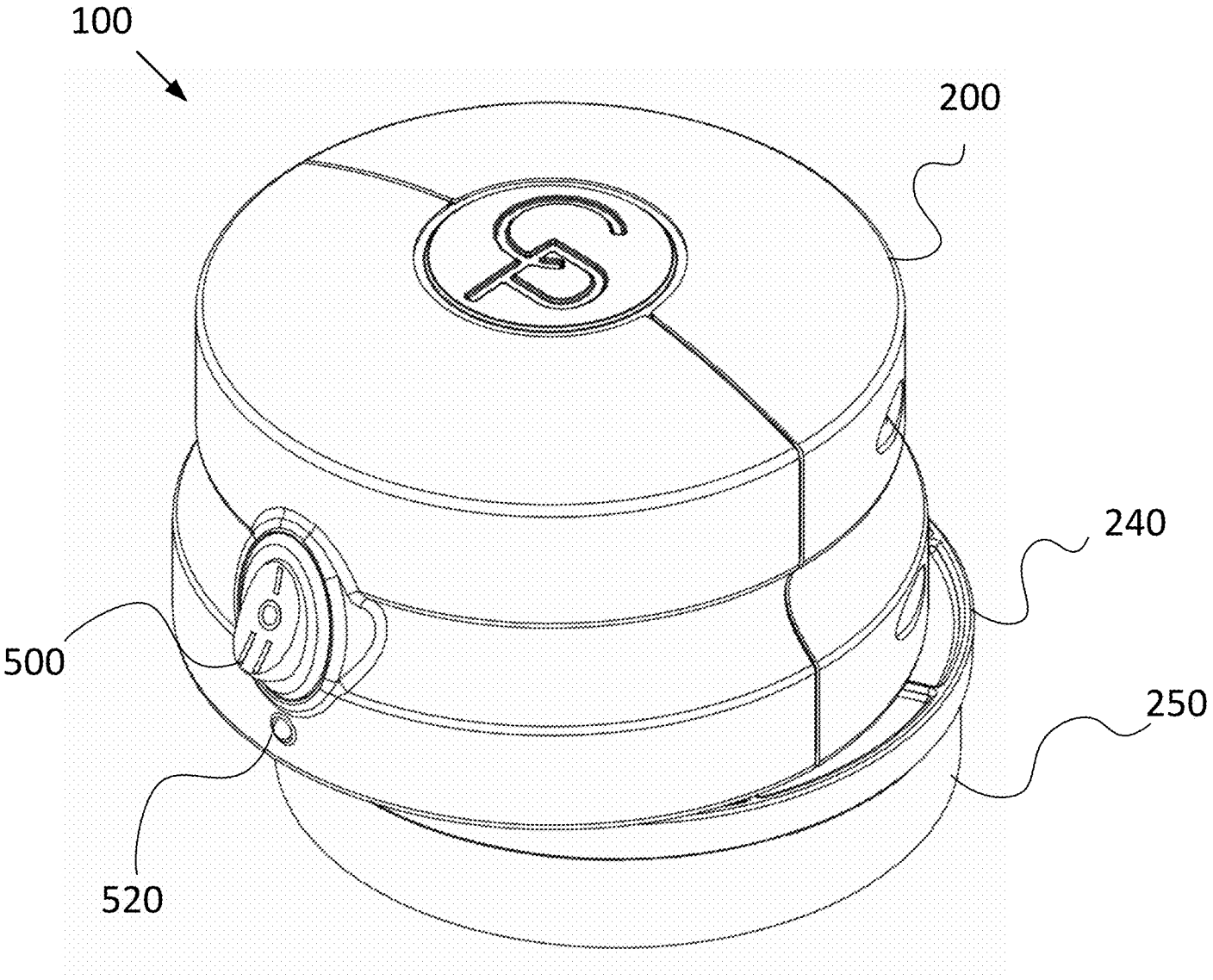
FIG. 1 is a perspective view consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

Throughout this document the terms "battery pack", "battery", and "batteries" may be used interchangeably to refer to one or more wet or dry cells or batteries of cells that provide DC power to the invention. References to recharging or replacing batteries may be construed to mean recharging or replacing individual cells, individual batteries of cells, or a package of multiple battery cells as is appropriate for any given battery technology that may be used.

As used herein, the word "control" is intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multipole, single throw, or multi-throw.

As used herein, the word "coupled", means connected, either directly or indirectly; the word coupled does not necessarily imply a mechanical connection. As used herein, the term "roto-linear motion", describes a complex motion where a first point of an element is following a linear, reciprocating path and a second point of the element is following a rotary path.

Throughout this document references to "wire", "wires", or "wiring" may describe and/or show a single conductor when, in fact, two conductors are required to power a subsystem or component; a convention used herein is to not show the common return conductor to which all electrical subsystems are connected—this common return conductor is a continuous electrical path and does not pass through any type of switch or other electrical component other than the possibility of passing through one or more connectors.

The handheld motorized hair styling device 100 comprises a hand grip 200, a styling disk 240, a styling pad 250, a circuit board 260, a motor 300, one or more batteries 350 and a user control 500. The handheld motorized hair styling device 100 is a device that is held by an operator above a head of a patron such that the styling pad 250 is in contact with hair of the patron. When the handheld motorized hair styling device 100 is activated, the styling pad 250 moves in a roto-linear motion relative to the hand grip 200 and imparts a styled pattern to the hair of the patron. The handheld motorized hair styling device 100 may be moved over the surface of the head of the patron to propagate the styled pattern throughout the hair of the patron. As a non-limiting example, the styled pattern may comprise twists, curls, coils, or a combination thereof.

The center of the styling disk 240 moves in a rotary motion 285 at the end of a crank arm 230 while an orientation peg 248 coupled to the styling disk 240 follows a reciprocating path 280 within an orientation channel 226 on the hand grip 200, creating the roto-linear motion of the styling disk 240. Since the styling pad 250 is coupled to the styling disk 240, the styling pad 250 also exhibits the roto-linear motion.

The hand grip 200 may be a circular shape when viewed from a top side 202, may having sloping or curved sides, and may have a gripping channel 265 around the midpoint of its circumference. The circular shape, sloping or curved sides, and the gripping channel 265 provide an ergonomic design that may make the handheld motorized hair styling device 100 more comfortable to hold in the palm of an operator's hand and may make it less likely that the handheld motorized hair styling device 100 will be dropped.

The hand grip 200 may serve as a housing for the motor 300, the one or more batteries 350, the circuit board 260, the user control 500, a power connector 320, and wiring (not illustrated in the figures). The hand grip 200 may comprise a front housing half 210 and a rear housing half 220. The front housing half 210 and the rear housing half 220 may be held together by a plurality of housing fasteners 222. The hand grip 200 may be fabricated from durable plastic.

A bottom side 203 of the hand grip 200 comprises the orientation channel 226, the purpose of which is to restrict motions of the styling disk 240. The orientation channel 226 comprises a lip 228 extending down from the hand grip 200 to form an elongated channel. The orientation channel 226 is at least as wide as the diameter of the orientation peg 248. The orientation channel 226 extends from a rear side 205 of the hand grip 200 to the crank arm 230, stopping short of the crank arm 230. Further details regarding the orientation channel 226 will be given in the description of the styling disk 240, which follows.

The circuit board 260 may couple to the front housing half 210 and to the rear housing half 220 inside of the hand grip 200 at the bottom side 203 of the hand grip 200. The user control 500 and an indicator 520 may protrude through openings on a front side 204 of the hand grip 200 and the power connector 320 may protrude through an opening on the rear side 205 of the hand grip 200. The motor 300 and the one or more batteries 350 are housed within the hand grip 200 and may be held in place by a combination of the hand grip 200 and the circuit board 260. For completeness of reference, the handheld motorized hair styling device 100 also comprises a left side 206 and a right side 207.

The crank arm 230 may couple to a motor shaft 310 and to the styling disk 240. Specifically, the motor shaft 310 may couple to the top side of one end of the crank arm 230, the crank arm 230 may extend in a horizontal direction from the motor shaft 310, and the styling disk 240 may couple to the bottom side of the other end of the crank arm 230. A set screw 235 may be used to couple the crank arm 230 to the motor shaft 310 and a disk bearing 242, a flat washer 244, and a disk retention screw 246 may be used to couple the styling disk 240 to the crank arm 230.

As the motor shaft 310 spins, the crank arm 230 moves the center of the styling disk 240 in the rotary motion 285. However, the orientation peg 248 on the top rear surface of the styling disk 240 is limited to following the reciprocating path 280, moving linearly within the orientation channel 226 on the bottom of the hand grip 200. The net motion of the styling disk 240, called the roto-linear motion, is such that the styling disk 240 moves both front to back and side to side but does not complete a full 360° rotation. While the styling disk 240 is moving, an orientation angle 237 drawn across the surface of the styling disk 240 from the orientation peg 248 through the center of the styling disk 240 oscillates 290 from side-to-side but always points towards the front side 204 of the handheld motorized hair styling device 100. Because the styling pad 250 is coupled to the styling disk 240, the motions of the styling pad 250 follow the roto-linear motion of the styling disk 240. The roto-linear motion is intended to simulate the motion of a sponge being manually rubbed in a circular motion against the hair.

The styling pad 250 comprises the interface between the handheld motorized hair styling device 100 and the hair of the patron. The bottom surface of the styling pad 250, which is the surface that comes into contact with the hair of the patron, may have a surface contour pattern 270 to help it move the hair. In some embodiments, the surface contour pattern 270 may be an egg crate pattern comprising a repeating pattern of peaks, dimples, and ridges.

The styling pad 250 may be fabricated from a closed-cell foam material. In some embodiments, the styling pad 250 may be fabricated from closed-cell silicon. In some embodiments, the styling pad 250 may be waterproof for easier cleaning.

The styling pads 250 may be replaceable and interchangeable. Here replaceable means that the styling pad 250 may be removed from the handheld motorized hair styling device 100 and a new one of the same type may be applied in its place. Interchangeable means that the styling pad 250 may be removed from the handheld motorized hair styling device 100 and replaced by one that has different characteristics. As non-limiting examples, different characterizes may include a different composition, a different height, a different surface contour pattern, a different arrangement of boreholes, or a combination thereof.

In some embodiments, the styling disk 240 and the styling pad 250 may be removable and replaceable as a single unit. In these embodiments the styling pad 250 may be permanently coupled to the styling disk 240. Removal/replacement of the styling pad 250 may therefore involve removing the disk retention screw 246, removing and replacing the styling disk 240 and the styling pad 250 as a unit, and replacing the disk retention screw 246.

In some embodiments, the styling pad 250 may removably couple with the styling disk 240. As non-limiting examples, the coupling between the styling disk 240 and the styling pad 250 may utilize a peel-and-stick self adhesive on the styling pad 250, loop and hook fasteners, multiple lips on the styling pad 250 flexing into multiple slots on the styling disk 240, some other temporary coupling arrangement, or combinations thereof.

The circuit board 260 routes electrical signals between subsystems and elements of the handheld motorized hair styling device 100 including, but not limited to, the one or more batteries 350, the motor 300, the user control 500, the power connector 320, and the indicator 520. These subsystems and elements may either couple directly to the circuit board 260 or may be coupled to the circuit board 260 via the wiring. The circuit board 260 may comprise passive and active electrical components not detailed here but necessary to implement functions such as recharging the battery, monitoring the battery, alerting on low battery conditions, controlling motor speed, and other control and monitoring functions.

The motor 300 may couple to the circuit board 260 using a plurality of motor fasteners 224. The motor 300 may also be physically supported by internal features of the hand grip 200. As a non-limiting example, the internal features of the hand grip 200 may be molded ribs. The motor 300 is oriented with the motor shaft 310 running from the top side 202 of the hand grip 200 to the bottom side 203 of the hand grip 200, with the motor shaft 310 extending through a hole in the circuit board 260, and exiting the hand grip 200 through a hole in the bottom side 203 of the hand grip 200.

The motor 300 is activated by passing electrical energy to the motor 300. The electrical energy may follow a path that passes through the one or more batteries 350, the circuit board 260, the user control 500, the motor 300, and the wiring. The operational state (on/off) of the motor 300 may be controlled by the user control 500. The direction of rotation of the motor 300 may be changed using a directional control (not illustrated in the figures). The speed of the motor 300 may be controlled by the user control 500.

The one or more batteries 350 comprises an internal source of power for the handheld motorized hair styling device 100. The one or more batteries 350 may be replaceable, rechargeable, or both. If the one or more batteries 350 are rechargeable, they may be recharged by the application of electrical power from an external charging adapter (not illustrated in the figures) applied to the power connector 320 and routed to the one or more batteries 350 via the circuit board 260. In some embodiments, the one or more batteries 350 may reside in one or more battery holders 355.

The user control 500 controls the flow of electrical power from the one or more batteries 350 to the motor 300. As non-limiting examples, the user control 500 may be a multi-positional rocker switch, pushbutton, rotary switch, slide switch, or other type of electrical switch. The user control 500 may be soldered directly to the circuit board 260 or may be coupled to the circuit board 260 via the wiring. In some embodiments, the user control 500 may be a three-position rocker switch with a low speed position 502, a high speed position 504, and an off position 506. When the user control 500 is in the off position 506, electrical power is prevented from flowing from the one or more batteries 350 to the motor 300. When the user control 500 is in the low speed position 502 or the high speed position 504 electrical power may flow from the one or more batteries 350 through the power connector 320 to the motor 300. When the user control 500 is in the low speed position 502, resistors or other electrical components may limit the flow of current to the motor 300 in order to reduce the rotational speed of the motor 300.

The directional control may control the rotational direction of the motor 300. As a non-limiting example, the directional control may be in the path of electrical energy routed to the motor 300 and may reverse the polarity of the electrical energy. The directional control may be accessible to the operator through an opening in the hand grip 200. As non-limiting examples, the directional control may be a rocker switch, pushbutton, rotary switch, slide switch, or other type of electrical switch. The directional control may be soldered directly to the circuit board 260 or may be coupled to the circuit board 260 via the wiring. In some embodiments, the directional control may be a pushbutton switch with a clockwise position and a counter-clockwise position. Each subsequent depression of the directional control may cause it to alternate between the clockwise position and the counter-clockwise position. When the directional control is in the clockwise position activation of the motor 300 will cause the motor 300 to rotate in a clockwise direction as viewed from the top side 202 of the hand grip 200. When the directional control is in the counter-clockwise position activation of the motor 300 will cause the motor 300 to rotate in a counter-clockwise direction as viewed from the top side 202 of the hand grip 200.

The power connector 320 may be accessible through an opening on the rear side 205 of the hand grip 200. The external charging adapter may be plugged into the power connector 320 to recharge the one or more batteries 350. In some embodiments, the power connector 320 may provide operational power to the handheld motorized hair styling device 100 while it is being used.

The indicator 520 may be visible through an opening on the front side 204 of the hand grip 200. The illumination state of the indicator 520, including but not limited to on/off, brightness, and blink rate, may be used to signal internal states of the handheld motorized hair styling device 100 to the operator. As non-limiting examples, the indicator 520 may be used to signal whether the handheld motorized hair styling device 100 is turned on, has a low battery, has completed recharging, has an overheating motor, and whether the motor 300 is operating at a low speed or a high speed.

A plurality of boreholes 255 may be voids in the styling pad 250 aligned perpendicularly to the surface of the styling pad 250 and parallel to the motor shaft 310. The plurality of boreholes 255 may be arranged in one or more repeating patterns around the center of the styling pad 250. The purpose of the plurality of boreholes 255 may be to provide space for the hair to move into as the roto-linear motion causes the hair to twist and coil. In some embodiments, the plurality of boreholes 255 may be hexagonal in shape. The plurality of boreholes 255 may also assist in the dissipation of heat generated by friction of the styling pad 250 rubbing against the hair.

In use, the hair of the patron is combed out. The handheld motorized hair styling device 100 is turned on by moving the user control 500 into either the low speed position 502 or the high speed position 504. The directional control is used to set a rotational direction. The operator then places the handheld motorized hair styling device 100 on any section of the hair of the patron. The styling pad 250 of the handheld motorized hair styling device 100 will cause friction against the hair from continuous rotation. The friction of the styling pad 250 against the hair will begin to grab and pull the hair and the hair will begin to twist and coil. Some of the hair will be drawn up into the plurality of boreholes 255. The operator may move the handheld motorized hair styling device 100 over the entire surface of the head of the patron until the desired the styled pattern is complete.

Turning now to FIG. 1, this figure presents a perspective view of an embodiment of the invention showing the hand grip 200, the styling disk 240, and the styling pad 250. The user control 500 and the indicator 520 are shown in their positions on the front side 204 of the hand grip 200.

Figure 2:
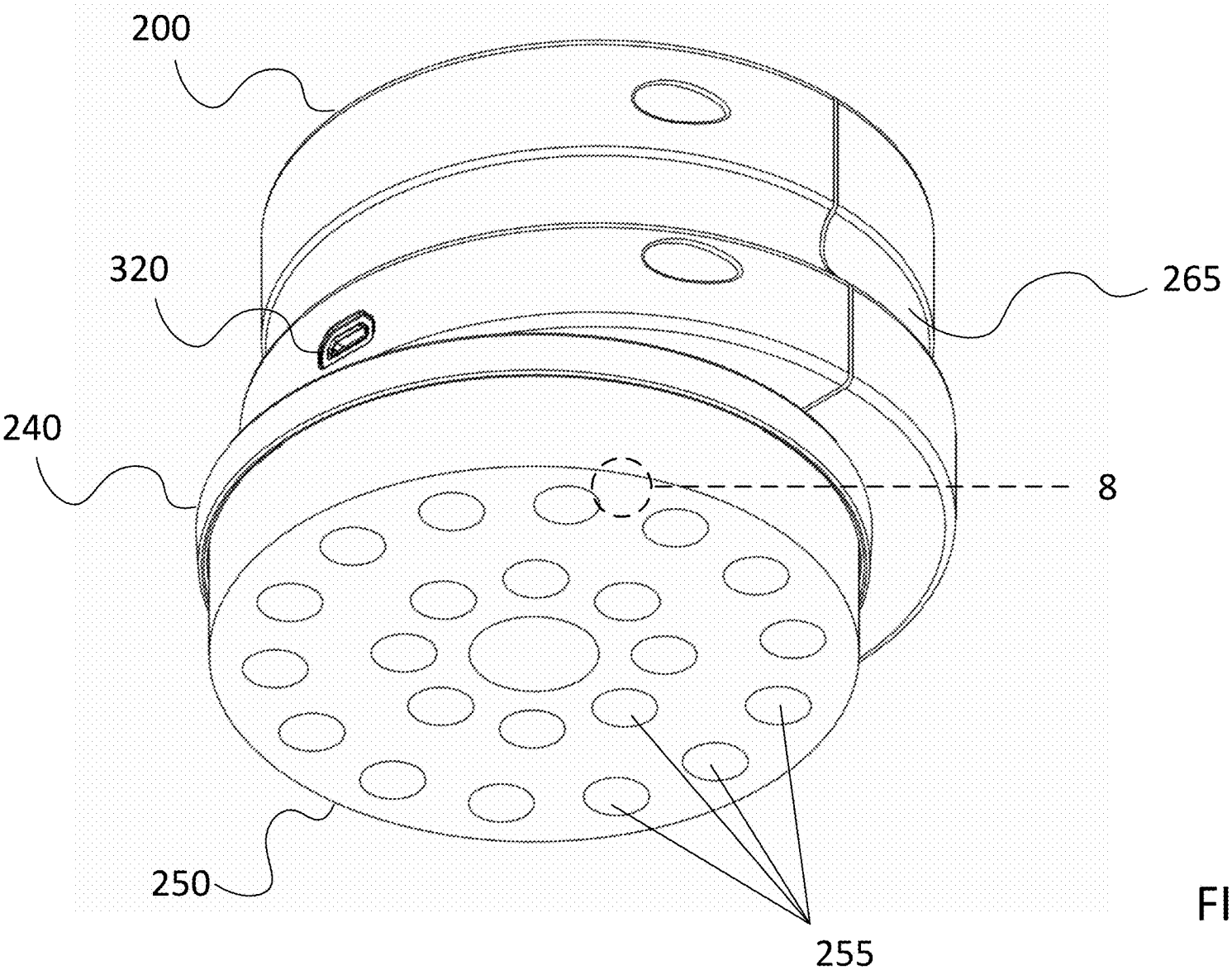
FIG. 2 is another perspective view from a position below and behind the handheld motorized hair styling device and consistent with certain embodiments of the present invention.

Turning now to FIG. 2, this figure presents another perspective view of an embodiment of the invention from a position below and behind the handheld motorized hair styling device 100. Highlighted are the gripping channel 265 which runs around the center of the hand grip 200, the styling disk 240, the styling pad 250, the power connector 320, and the plurality of boreholes 255 on the styling pad 250.

Figure 3:
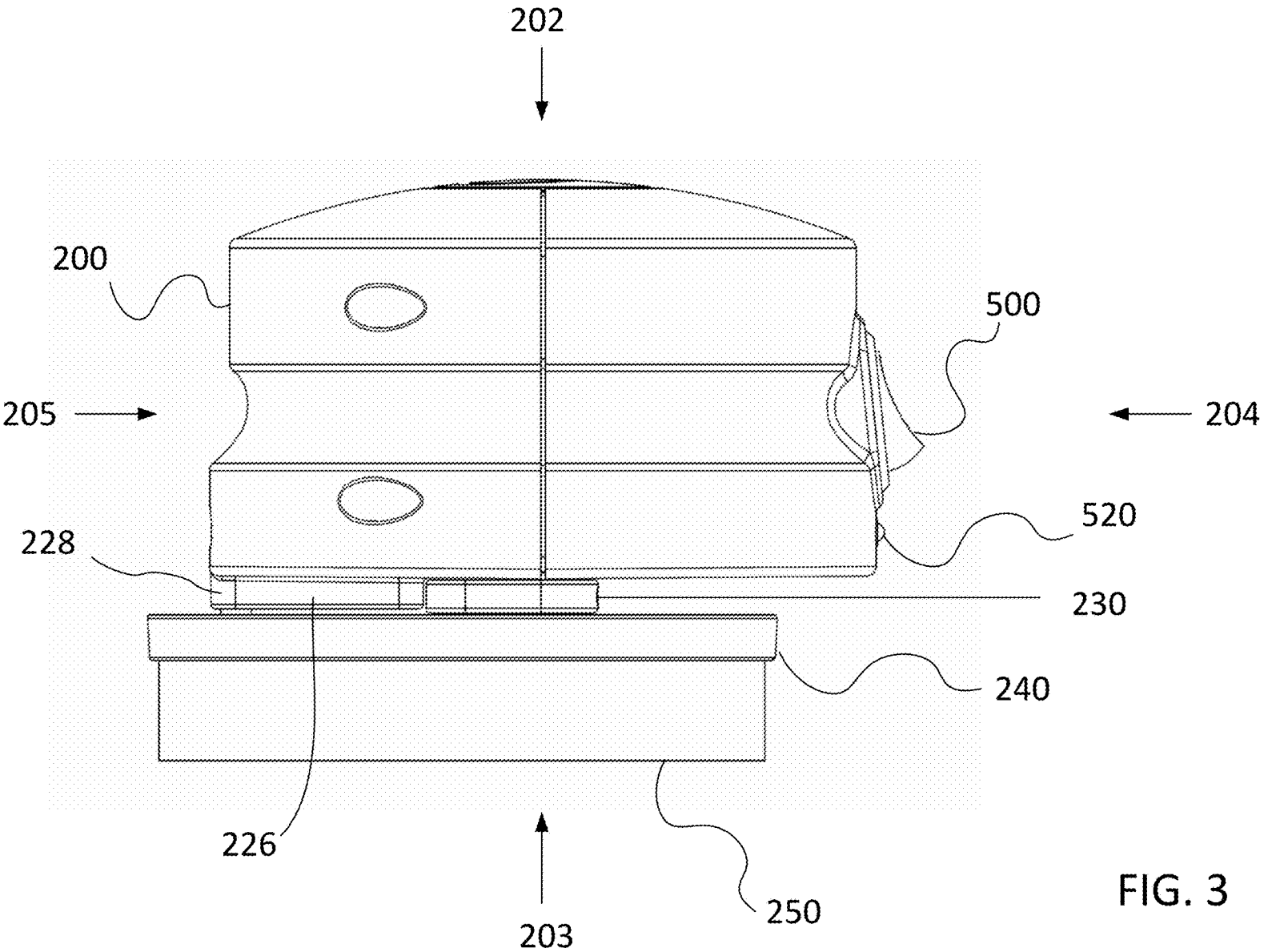
FIG. 3 is a side view consistent with certain embodiments of the present invention.

Turning now to FIG. 3, this figure presents a side view of an embodiment of the invention. Note in this figure the lip 228 extending down from the lower rear surface of the hand grip 200 to form the lip 228

Figure 4:
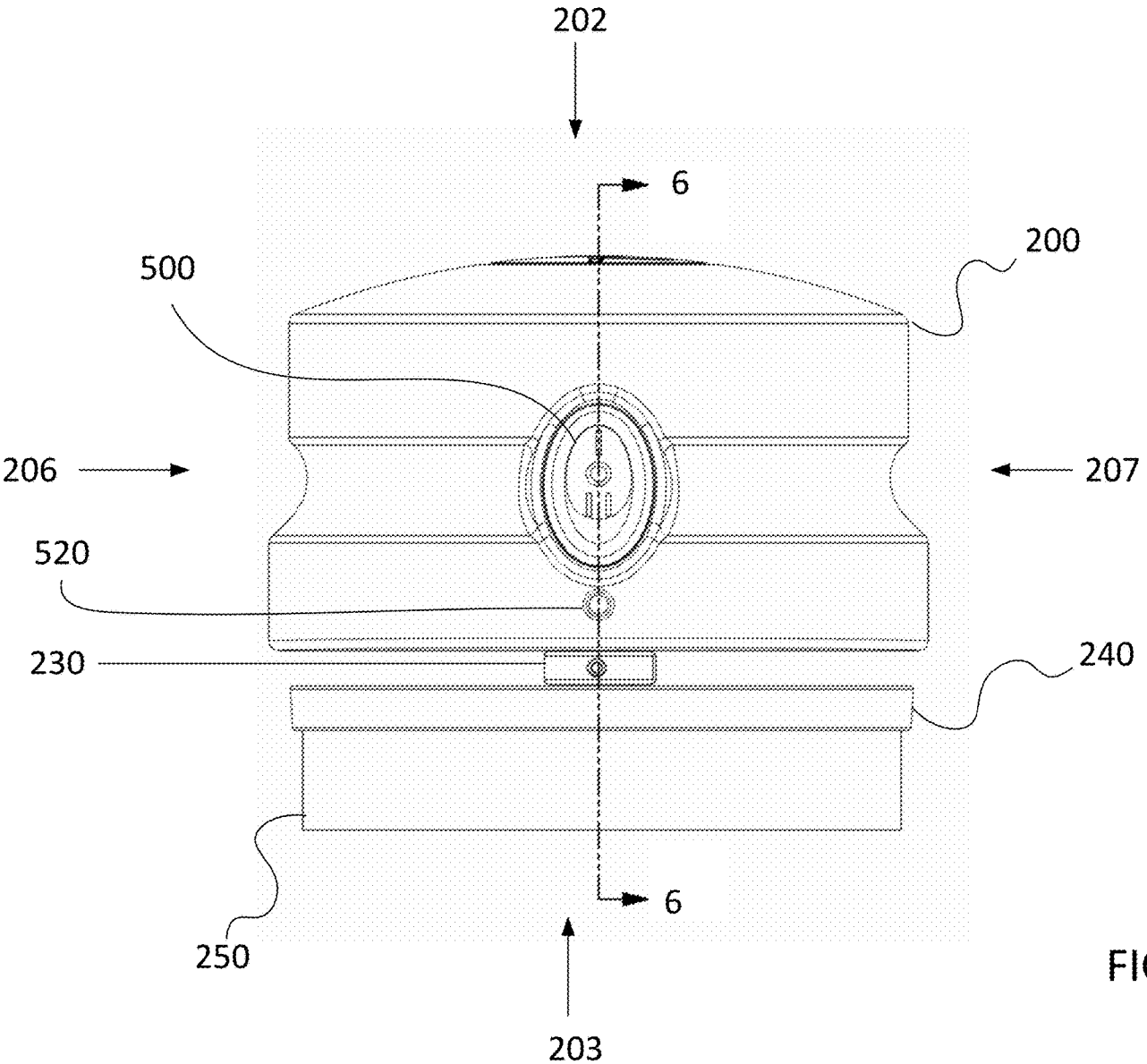
FIG. 4 is a front view consistent with certain embodiments of the present invention.

Turning now to FIG. 4, this figure presents a front view of an embodiment of the invention.

Figure 5:
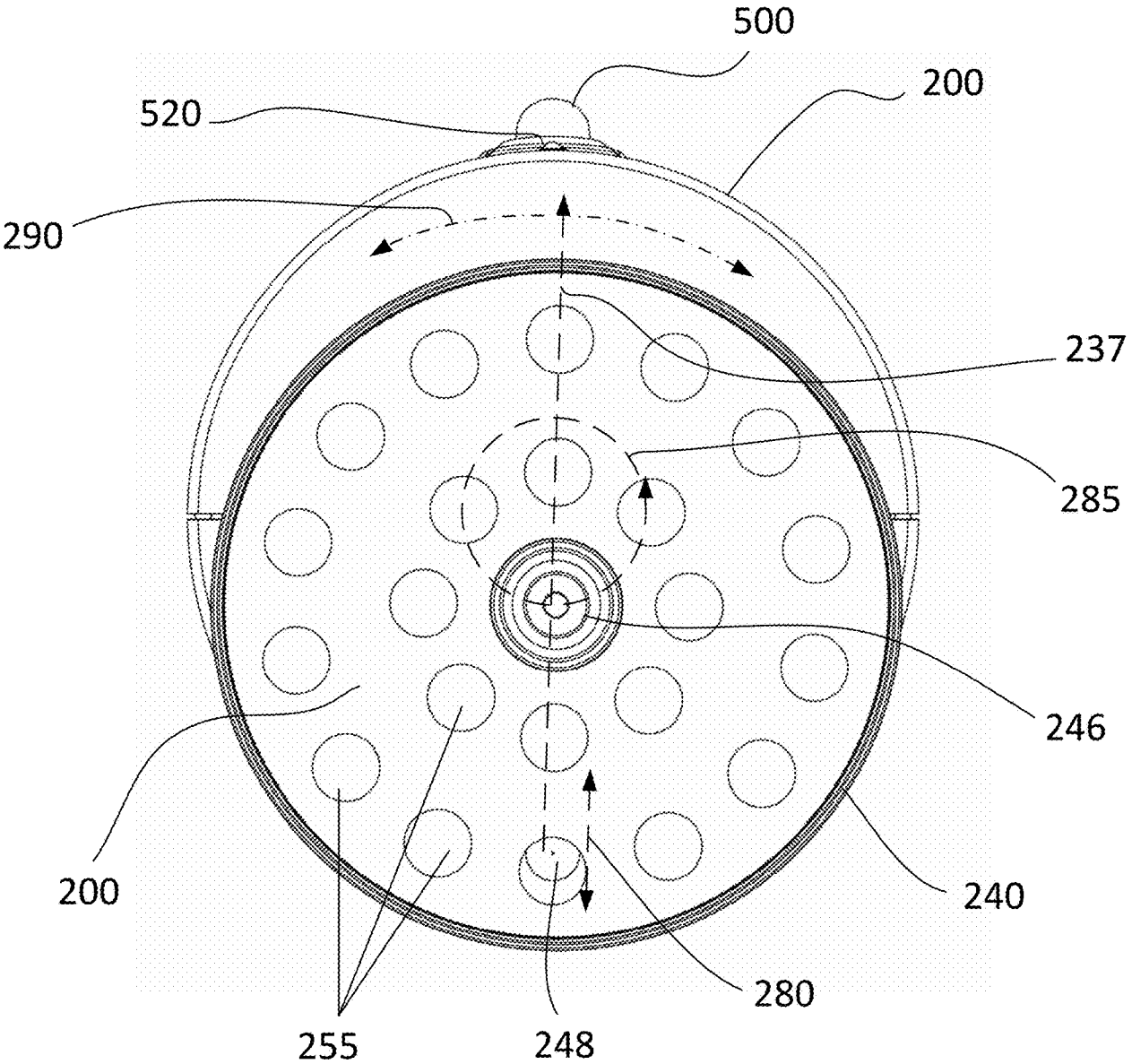
FIG. 5 is a bottom view consistent with certain embodiments of the present invention.

Turning now to FIG. 5, this figure presents a bottom view of an embodiment of the invention. The plurality of boreholes 255 are clearly visible in this figure and the orientation angle 237 of the styling disk 240 for this particularly placement of the styling disk 240 is also illustrated. In some embodiments, the styling pad 250 and the styling disk 240 may be removed by removing the disk retention screw 246 shown in the figure.

Figure 6:
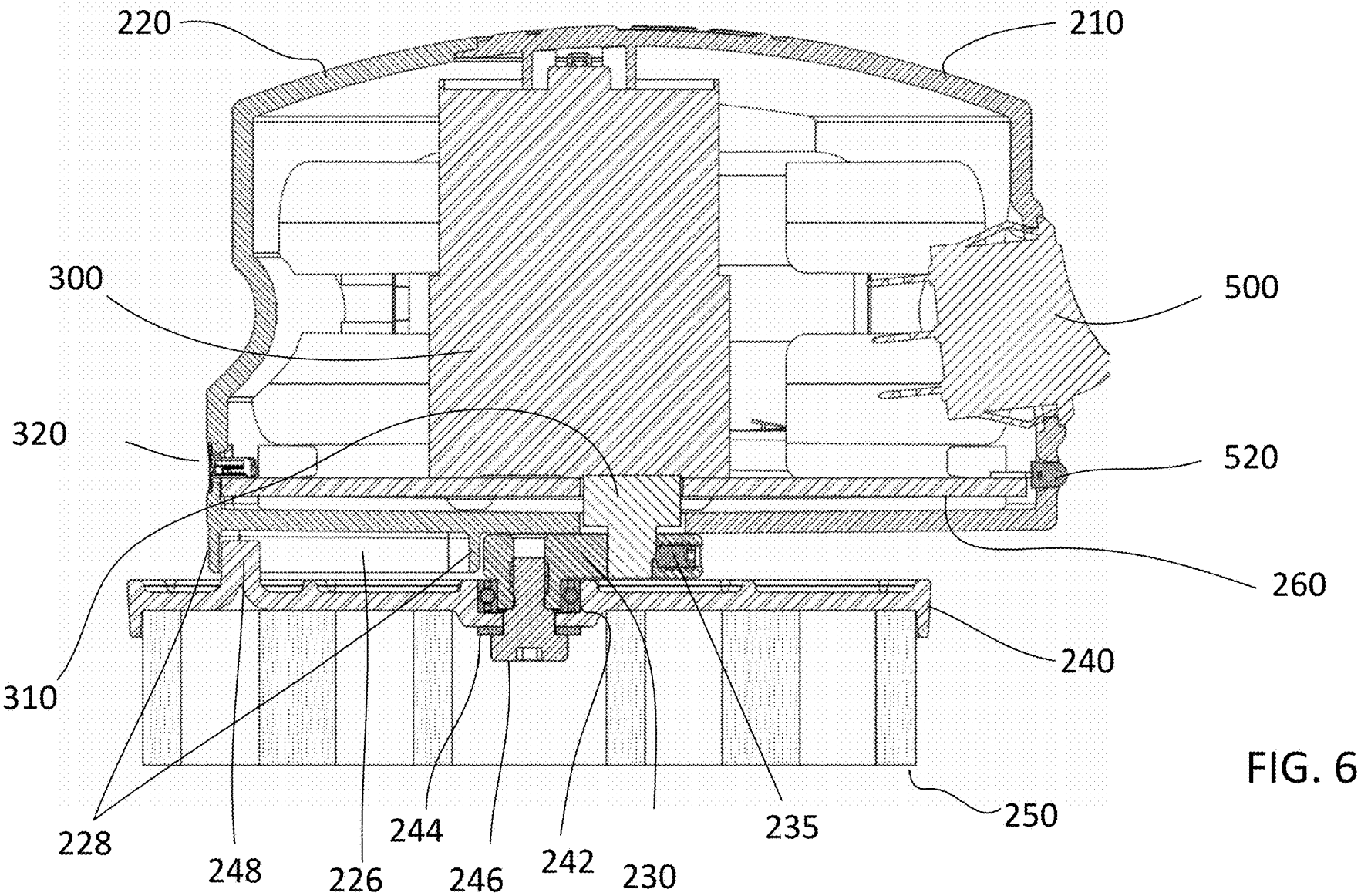
FIG. 6 is a cross-sectional view of section 6-6 in FIG. 4, consistent with certain embodiments of the present invention.

Turning now to FIG. 6, this figure presents a cross-sectional view of section 6-6 in FIG. 4. It may be seen from this illustration that the motor shaft 310 extends downward from the motor 300 into the crank arm 230 and that the motor shaft 310 is held in place in the crank arm 230 by the set screw 235. Also shown are the attachment of the styling disk 240 to the crank arm 230 via the disk retention screw 246 and the placement of the disk bearing 242. The positioning of the orientation peg 248 within the orientation channel 226 formed by the lip 228 can be clearly seen.

Figure 7:
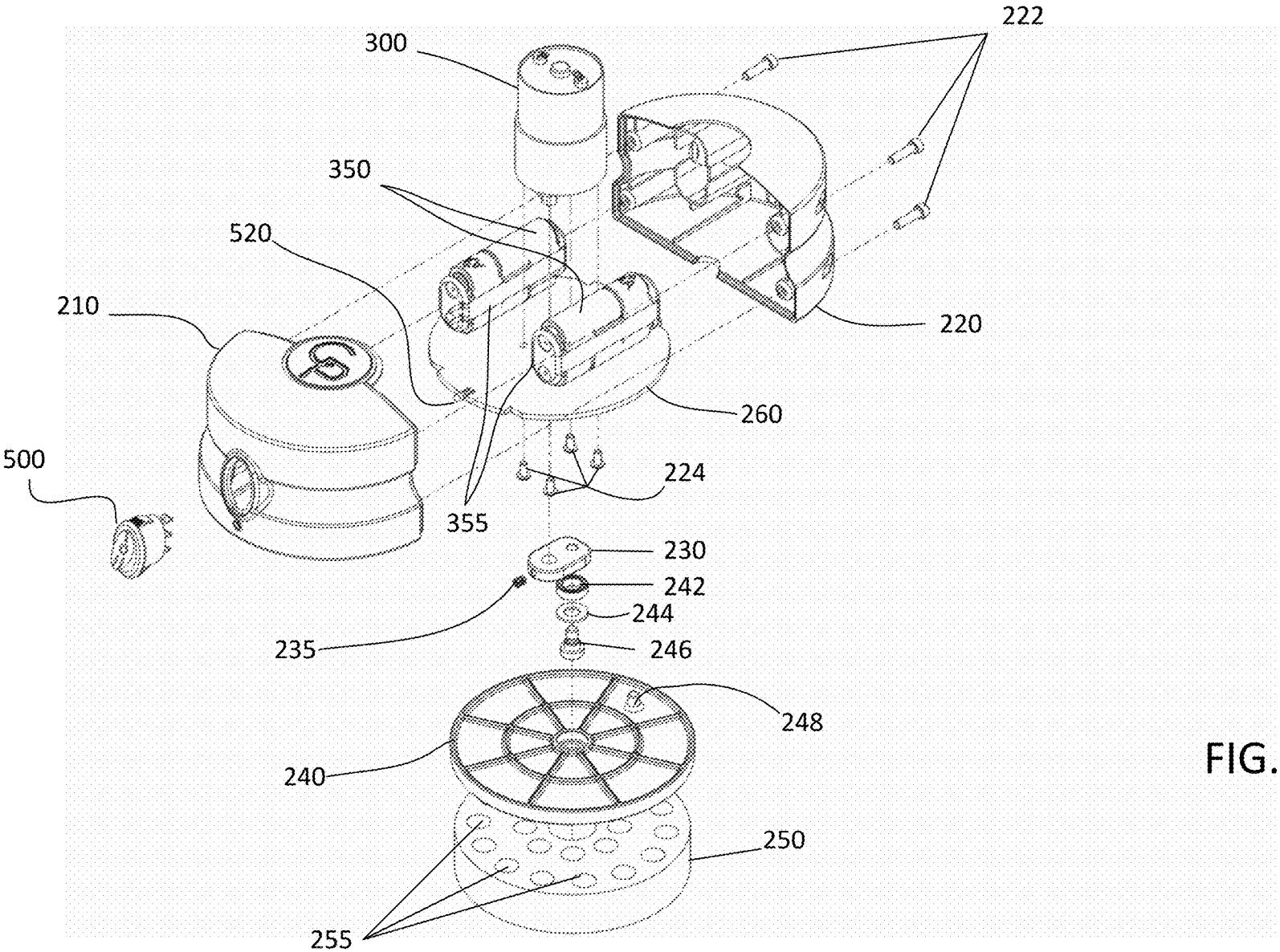
FIG. 7 is an exploded view consistent with certain embodiments of the present invention.

Turning now to FIG. 7, this figure presents an exploded view of an embodiment of the invention.

Figure 8:
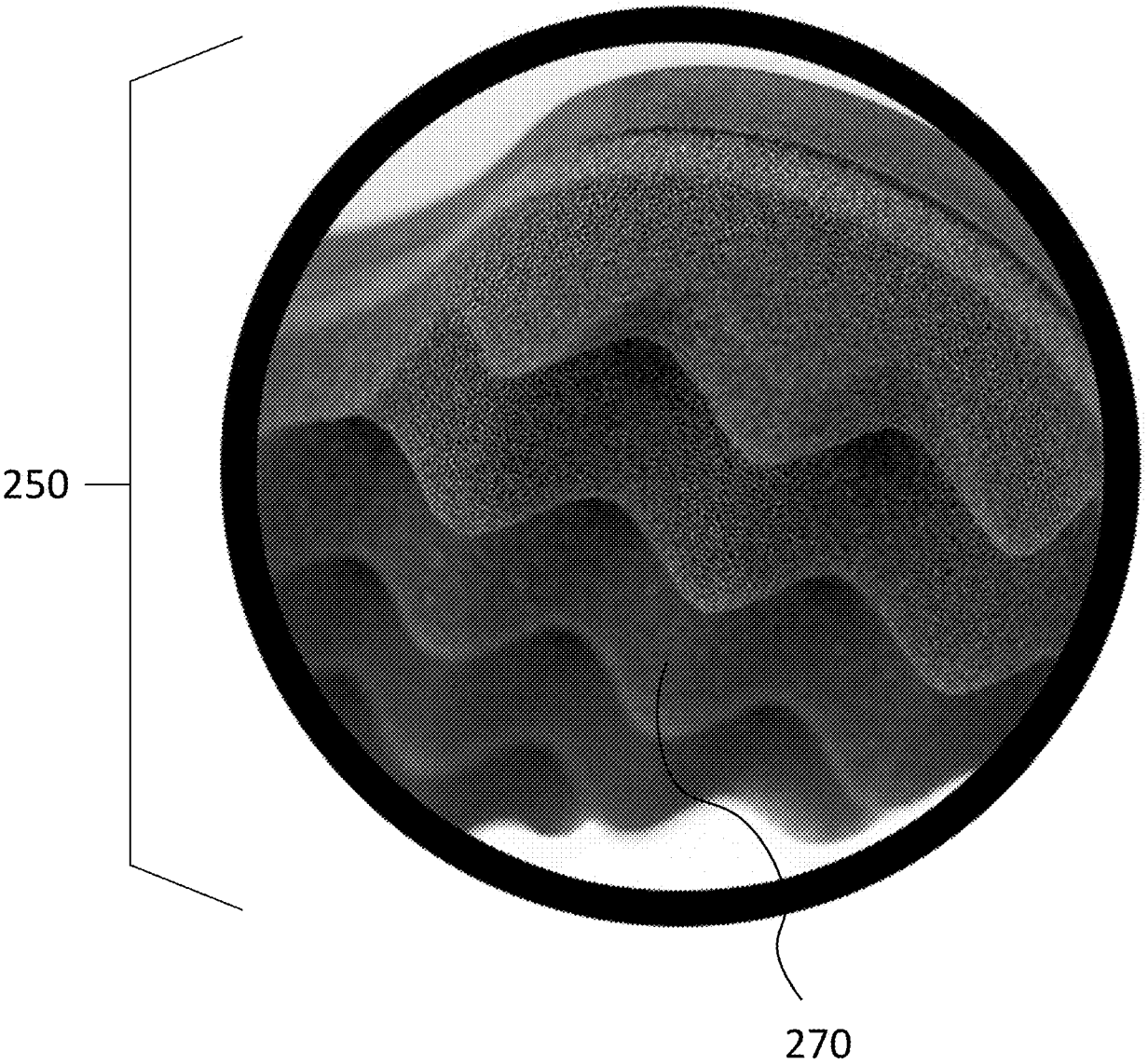
FIG. 8 is a detail view of an area identified in FIG. 2, consistent with certain embodiments of the present invention.

Turning now to FIG. 8, this figure presents a detail view representative of the styling pad 250 from the area indicated in FIG. 2. The surface contour pattern 270 is shown—in this case the surface contour pattern 270 is an egg crate pattern.

While certain illustrative embodiments have been described, it is evident that many alternatives, modifications, permutations and variations will become apparent to those skilled in the art in light of the foregoing description.

What is claimed is:

1. A handheld motorized hair styling device comprising a hand grip, a styling disk, a styling pad, a circuit board, a motor, one or more batteries and a user control;

where the handheld motorized hair styling device is a device that is held by an operator above a head of a patron such that the styling pad is in contact with hair of the patron;

where the center of the styling disk moves in a rotary motion at the end of a crank arm while an orientation peg coupled to the styling disk follows a reciprocating path within an orientation channel on the hand grip, creating the roto-linear motion of the styling disk;

where the styling pad moves in a roto-linear motion relative to the hand grip when the handheld motorized hair styling device is activated;

where the styling pad is coupled to the styling disk and the styling pad exhibits the roto-linear motion;

where the styling pad imparts a styled pattern to the hair of the patron;

where the handheld motorized hair styling device is moved over the surface of the head of the patron to propagate the styled pattern throughout the hair of the patron.

2. The handheld motorized hair styling device according to claim 1, where the hand grip serves as a housing for the motor, the one or more batteries, the circuit board, the user control, a power connector, and wiring;

where the hand grip comprises a front housing half and a rear housing half;

where the front housing half and the rear housing half are held together by a plurality of housing fasteners.

3. The handheld motorized hair styling device according to claim 1, where a bottom side of the hand grip comprises the orientation channel;

where the orientation channel comprises a lip extending down from the hand grip to form an elongated channel;

where the orientation channel is at least as wide as the diameter of the orientation peg;

where the orientation channel extends from a rear side of the hand grip to the crank arm and stops short of the crank arm.

4. The handheld motorized hair styling device according to claim 3 where the circuit board couples to the front housing half and to the rear housing half inside of the hand grip at the bottom side of the hand grip;

where the user control and an indicator protrude through openings on a front side of the hand grip;

where the power connector protrudes through an opening on the rear side of the hand grip;

where the motor and the one or more batteries are housed within the hand grip and are held in place by a combination of the hand grip and the circuit board.

5. The handheld motorized hair styling device according to claim 3 where a motor shaft couples to a top side of one end of the crank arm;

where the crank arm extends in a horizontal direction from the motor shaft;

where the styling disk couples to the bottom side of the other end of the crank arm;

where a set screw is used to couple the crank arm to the motor shaft;

where a disk bearing, a flat washer, and a disk retention screw are used to couple the styling disk to the crank arm.

6. The handheld motorized hair styling device according to claim 5 where the crank arm moves the center of the styling disk in the rotary motion as the motor shaft spins;

where the orientation peg on the top rear surface of the styling disk is limited to following the reciprocating path, moving linearly within the orientation channel on the bottom of the hand grip;

where the roto-linear motion of the styling disk is such the styling disk moves both front to back and side to side but does not complete a full 360° rotation;

where an orientation angle drawn across the surface of the styling disk from the orientation peg through the center of the styling disk oscillates from side-to-side but always points towards the front side of the handheld motorized hair styling device during roto-linear motion of the styling disk.

7. The handheld motorized hair styling device according to claim 6 where the styling pad comprises the interface between the handheld motorized hair styling device and the hair of the patron;

where the bottom surface of the styling pad has a surface contour pattern to move the hair.

8. The handheld motorized hair styling device according to claim 7 where the surface contour pattern is an egg crate pattern.

9. The handheld motorized hair styling device according to claim 7 where the styling pad is fabricated from a closed-cell foam material where the styling pad is waterproof for easier cleaning.

10. The handheld motorized hair styling device according to claim 9 where the styling pad is replaceable and interchangeable.

11. The handheld motorized hair styling device according to claim 10 where the styling disk and the styling pad are removable and replaceable as a single unit.

12. The handheld motorized hair styling device according to claim 10 where the styling pad is removably coupled with the styling disk.

13. The handheld motorized hair styling device according to claim 10 where the circuit board routes electrical signals between subsystems and elements of the handheld motorized hair styling device.

14. The handheld motorized hair styling device according to claim 13 where the motor is oriented with the motor shaft running from the top side of the hand grip to the bottom side of the hand grip;

where the motor shaft exits the hand grip through a hole in the bottom side of the hand grip.

15. The handheld motorized hair styling device according to claim 14 where the motor is activated by passing electrical energy to the motor;

where the operational on/off state of the motor is controlled by the user control;

where the speed of the motor is controlled by the user control;

where the user control is a three-position rocker switch with a low speed position, a high speed position, and an off position.

16. The handheld motorized hair styling device according to claim 15 where the direction of rotation of the motor is changed using a directional control.

17. The handheld motorized hair styling device according to claim 15 where the one or more batteries comprises an internal source of power for the handheld motorized hair styling device;

where the one or more batteries are replaceable, rechargeable, or both;

where the one or more batteries are recharged by the application of electrical power from an external charging adapter applied to the power connector and routed to the one or more batteries via the circuit board.

18. The handheld motorized hair styling device according to claim 17 where the indicator is visible through an opening on the front side of the hand grip;

where the illumination state of the indicator is used to signal internal states of the handheld motorized hair styling device to the operator.

19. The handheld motorized hair styling device according to claim 10 where a plurality of boreholes are voids in the styling pad aligned perpendicularly to the surface of the styling pad and parallel to the motor shaft;

where the plurality of boreholes are arranged in one or more repeating patterns around the center of the styling pad.

* * * * *